US007731171B2

(12) United States Patent
Ohishi et al.

(10) Patent No.: US 7,731,171 B2
(45) Date of Patent: Jun. 8, 2010

(54) PAPER FEEDING DEVICE AND IMAGE FORMING APPARATUS

(75) Inventors: Masatsugu Ohishi, Hyogo (JP); Masaharu Kimura, Osaka (JP); Norichika Katsura, Nara (JP); Yasuaki Fukada, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 12/406,245

(22) Filed: Mar. 18, 2009

(65) Prior Publication Data

US 2009/0243188 A1 Oct. 1, 2009

(30) Foreign Application Priority Data

Mar. 28, 2008 (JP) ..... 2008-087311

(51) Int. Cl.
*B65H 5/00* (2006.01)
*B65H 3/04* (2006.01)

(52) U.S. Cl. ..... 271/10.06; 271/34; 271/117

(58) Field of Classification Search ..... 271/34, 271/117, 10.06, 10.07, 10.08
See application file for complete search history.

(56) References Cited

U.S. PATENT DOCUMENTS 4,607,832 A * 8/1986 Abe ..... 271/10.08
5,678,814 A * 10/1997 Yokoyama et al. ..... 271/9.05
6,554,270 B2 * 4/2003 Yamamoto ..... 271/117
7,267,333 B2 * 9/2007 Kawachi et al. ..... 271/114
7,464,924 B2 * 12/2008 Morimoto et al. ..... 271/118
7,530,561 B2 * 5/2009 Lan et al. ..... 271/34
2005/0023745 A1 * 2/2005 Morimoto et al. ..... 271/117

FOREIGN PATENT DOCUMENTS

JP 2000-185833 7/2000
JP 2002-037465 2/2002
JP 2003-171026 6/2003
JP 2003-181836 7/2003

* cited by examiner

*Primary Examiner*—Kaitlin S Joerger
(74) *Attorney, Agent, or Firm*—Renner, Otto, Boisselle & Sklar, LLP

(57) ABSTRACT

As one embodiment, a paper feeding device is provided with a pickup roller for pulling out an uppermost positioned sheet of loaded sheets, and a paper feeding roller for transporting the sheet pulled out by the pickup roller. Spanning between the pickup roller and the paper feeding roller, a roller belt is provided that is capable of moving relatively in a circumferential direction with respect to an outer circumferential surface of the paper feeding roller. The roller belt obtains rotational drive from the pickup roller.

6 Claims, 8 Drawing Sheets

PAPER FEEDING DEVICE AND IMAGE FORMING APPARATUS

CROSS-REFERENCE TO RELATED APPLICATION

This application claims priority under 35 U.S.C. §119(a) on Patent Application No. 2008-87311 filed in Japan on Mar. 28, 2008, the entire contents of which are hereby incorporated by reference.

BACKGROUND OF THE INVENTION

The present invention relates to paper feeding devices that can be applied in apparatuses such as image forming apparatuses that carry out predetermined processing on sheets such as papers, and particularly relates to paper feeding devices in which a pickup roller pulls out an uppermost positioned sheet of loaded sheets and a paper feeding roller transports the sheet pulled out by the pickup roller, and image forming apparatuses provided with these paper feeding devices.

Generally, a paper feeding device is provided in an apparatus such as an image forming apparatus that carries out predetermined processing on sheets, and this paper feeding device is provided with a paper feeding mechanism that feeds the sheet positioned at an uppermost portion of the loaded sheets in order sheet by sheet toward a transport path.

The paper feeding mechanism may be provided with a pickup roller for pulling out an uppermost positioned sheet of the loaded sheets, and a paper feeding roller for transporting the sheet pulled out by the pickup roller.

In this regard, when sheets such as papers are left exposed to open air or for example, when sheets are left loaded in a sheet housing portion, the sheets sometimes curl due to the effects of humidity or temperature or the like. Furthermore, for example, curling may occur in which edge portions become gradually higher than a central area in a sheet transport direction. When this happens, the following problems may occur.

Generally, curling occurs easily in sheets depending on ordinary ambient environment conditions. For example, there are cases of environment conditions of a low temperature and low humidity or a high temperature and high humidity, more specifically, there are cases of a low temperature and low humidity of 10° C., 20% RH, or a high temperature and high humidity of 30° C., 85% RH. In particular, in cases where curling has occurred in sheets of a certain thickness having a basis weight (grammage) of 100 g/m$^2$ or greater such as firm cardboards and glossy papers or the like, problems occur of sheet blockages (hereinafter referred to as jamming).

Hereinafter, description is given regarding problems in feeding caused by sheet curling according to a paper feeding device provided with a pickup roller and a paper feeding roller. It should be noted that the following description sets forth an example of a case using a rotating board as a loading member capable of being loaded with sheets that is rotatable on an axis along a horizontal direction orthogonal to a sheet transport direction.

FIG. 7A and FIG. 7B and FIG. 8A and FIG. 8B are schematic views for describing a conventional paper feeding device 120 provided with a pickup roller 202 and a paper feeding roller 203. FIG. 7A shows a state in which sheets P, which are not curled, have been lowered within a sheet housing unit 80 and FIG. 7B shows a state in which the uncurled sheets P are being transported after being raised in the sheet housing unit 80. Furthermore, FIG. 8A shows a state in which sheets P, which have curled, have been lowered within the sheet housing unit 80 and FIG. 8B shows a state in which the curled sheets P are being transported after being raised in the sheet housing unit 80. It should be noted that the dashed line in FIG. 8B shows a transport trajectory of the sheet P leading edge.

In the paper feeding device 120, when the rotating board 121 is caused to rotate from a state shown in FIG. 7A so as to approach the pickup roller 202 and a bundle of regular, uncurled sheets P is raised by the rotating board 121, an uppermost positioned sheet P contacts the pickup roller 202, and when the sheets P are further raised, a detector piece 207, which is a second detection member that moves integrally with the pickup roller 202 is detected as shown in FIG. 7B by a photosensor 208, which is a first detection member, and the raising of the sheets P stops. Then, the pickup roller 202 feeds out the sheet P from the sheet housing unit 80 to a nip portion γ between the paper feeding roller 203 and a separator roller 204, and the sheets P are transported sheet by sheet.

In this regard, a transport guide member 206 for example is sometimes provided between the pickup roller 202 and the paper feeding roller 203 to smoothly guide the paper P from the pickup roller 202 to the paper feeding roller 203.

Accordingly, when the sheet P has curled due to the effects of humidity or temperature or the like, the sheet P may contact a portion of the transport guide member 206 during transport of the sheet P as shown in FIG. 8A and FIG. 8B (see a portion in FIG. 8B). With a downstream side edge portion in the transport direction of the sheet P given as leading edge portion P1, when the leading edge portion P1 of the curled sheet P is transported while in contact with the transport guide member 206, there is a risk that the transport force will be reduced due to the frictional load at the contact portion α between the sheet P and the transport guide member 206. Due to this, paper feeding problems may occur such as paper feeding delays or jamming due the leading edge portion P1 of the sheet P being obstructed.

In order to improve the transport force of the sheets, JP 2003-171026A (patent document 1) proposes a paper feeding device that is provided with various paper feeding rollers for separation and for drawing in sheets, which are rotationally driven while pressing against an upper surface of the sheets loaded on the paper feeding platform and arranged with intervals in the paper feeding direction, and these paper feeding rollers are arranged in a width direction central area of the paper, and assistive paper feeding rollers of a lower rigidity than the paper feeding rollers for drawing in are arranged on a same axis with intervals in the paper width direction at the end sides of the paper feeding rollers for drawing in.

However, in the paper feeding device described in patent document 1, in the case where the transport guide member is provided between the paper feeding roller for drawing in and the paper feeding roller for separation as in the configuration shown in FIG. 7A, even if the assistive paper feeding rollers are provided on a same axis as the pickup roller, contact of the curled papers to the transport guide member is not avoided, and it is difficult to prevent occurrences of paper feeding problems such as paper feeding delays or jamming or the like caused by curling.

Furthermore, configurations have been proposed in which a roller belt is attached at an outer circumferential region between the paper feeding roller and the pickup roller, thereby applying a transport force to the curled sheets by the belt transport. In paper feeding devices having this configuration, by attaching the roller belt at an outer circumferential region between the paper feeding roller and the pickup roller, curled sheets move with the roller belt when contact is made with the roller belt, and in this way a transport force can be applied to the sheet.

Further still, JP 2002-37465A (patent document 2) proposes a paper feeding device in which a transport belt is wound around a transport direction downstream side pulley and an upstream side pulley so as to surround a negative pressure generating device that generates a negative pressure at a bottom surface, and the recording papers are drawn in and transported due to the negative pressure.

However, in conventional paper feeding devices in which a roller belt is attached between the paper feeding roller and the pickup roller, although a transport force can be applied to curled sheets, there is also a problem such as the following.

Namely, the paper feeding roller and the pickup roller are rotated in synchronization due to the roller belt attached therebetween. For this reason, even after the sheet has passed it, the pickup roller continues to rotate in cooperation with the rotation of the paper feeding roller. Consequently, since it unfortunately rotates in cooperation with the paper feeding roller even after the uppermost positioned sheet has been fed by the pickup roller, a new problem occurs in that a next sheet loaded on the loading member is picked up by the rotation of the pickup roller working in cooperation with the paper feeding roller.

SUMMARY OF THE INVENTION

The present invention has been devised in light of these problems and it is an object thereof to provide a paper feeding device and an image forming apparatus provided with this in which, in using the paper feeding roller to transport the sheet pulled out by the pickup roller, a transport force can be applied to the curled sheet without pulling out the next sheet, and in this way paper feeding problems such as paper feeding delays and jamming caused by curling can be reliably prevented.

In order to address these issues, the present invention provides a paper feeding device that is provided with a pickup roller for pulling out an uppermost positioned sheet of loaded sheets, and a paper feeding roller for transporting the sheet pulled out by the pickup roller, wherein spanning between the pickup roller and the paper feeding roller, a roller belt is provided that is capable of moving relatively in a circumferential direction with respect to an outer circumferential surface of the paper feeding roller, and the roller belt obtains rotational drive from the pickup roller. Furthermore, the present invention provides an image forming apparatus that is provided with a paper feeding device according to the present invention.

With the paper feeding device and image forming apparatus according to the present invention, a transport force is applied to curled sheets through the roller belt, which spans between the pickup roller and the paper feeding roller, thereby making it possible to smoothly transport the curled sheets. Moreover, the roller belt is capable of moving relatively in the circumferential direction with respect to the outer circumferential surface of the paper feeding roller and obtains rotational drive from the pickup roller, and therefore after a sheet has passed the pickup roller, it is capable of stopping in a state in which the rotation of the pickup roller is independent from the rotation of the paper feeding roller. That is, the pickup roller can stop rotation independent from the paper feeding roller even when the paper feeding roller is rotating after the uppermost positioned sheet of the loaded sheets has been fed, and consequently does not pull out the next sheet.

With the present invention, in using the paper feeding roller to transport the sheet pulled out by the pickup roller, a transport force can be applied to the curled sheet without pulling out the next sheet, and in this way paper feeding problems such as paper feeding delays and jamming caused by curling can be reliably prevented. This is particularly effective, for example, in the case where thick papers such as cardboards and glossy papers are used as the sheets.

In the present invention it is preferable that a freely rotating roller arranged on a same axis as the paper feeding roller is provided, and that the roller belt spans between the pickup roller and the rotating roller.

In this way, the rotating roller is provided to readily rotate on a same axis as the paper feeding roller, and the roller belt is provided spanning between the pickup roller and the rotating roller, and therefore even though the configuration is simple, after a sheet has passed the pickup roller, the rotation of the pickup roller can be reliably stopped in a state independent from the rotation of the paper feeding roller.

In the present invention, in the case where the rotating roller is provided for example, it is preferable that the roller belt is installed such that an outer diameter of a portion winding around the paper feeding roller side such as the rotating roller is smaller than a diameter of the paper feeding roller.

In this way, a sheet that has passed the pickup roller can be reliably transported by the paper feeding roller.

Furthermore, in the present invention it is preferable that the roller belt is installed such that an outer diameter of a portion winding around the pickup roller side is not greater than a diameter of the pickup roller.

In this way, an uppermost positioned sheet of the loaded sheets can be reliably pulled out by the pickup roller.

With the present invention, in using the paper feeding roller to transport the sheet pulled out by the pickup roller, a transport force can be applied to the curled sheet without pulling out the next sheet, and in this way paper feeding problems such as paper feeding delays and jamming caused by curling can be reliably prevented.

BRIEF DESCRIPTION OF THE DRAWINGS

FIG. 4A is a descriptive diagram of a state in which uncurled papers are lowered within the paper feeding tray as viewed from the front, and FIG. 4B is a descriptive diagram of a state in which uncurled papers are raised within the paper feeding tray as viewed from the front.

FIG. 5A is a top view of the paper feeding device and the paper feeding tray, and FIG. 5B is a descriptive diagram of the paper feeding device and the paper feeding tray as viewed from a rear surface.

FIG. 6A is a lateral view showing a pickup roller and a paper feeding roller of the paper feeding device, and peripheral components thereof, FIG. 6B is a top view of the pickup roller and the paper feeding roller portions of the paper feeding device, and FIG. 6C is a cross-sectional view of the pickup roller and the paper feeding roller portions of the paper feeding device.

FIG. 7A shows a state in which sheets, which are not curled, have been lowered within a sheet housing unit. FIG. 7B shows a state in which the uncurled sheets are being transported after being raised in the sheet housing unit.

FIG. 8A shows a state in which sheets, which are curled, have been lowered within a sheet housing unit. FIG. 8B shows a state in which the curled sheets are being transported after being raised in the sheet housing unit.

DESCRIPTION OF THE PREFERRED EMBODIMENTS

Hereinafter, a paper feeding device and an image forming apparatus according to an embodiment of the present invention are described with reference to the accompanying drawings.

Overall Configuration of Image Forming Apparatus

Figure 1:
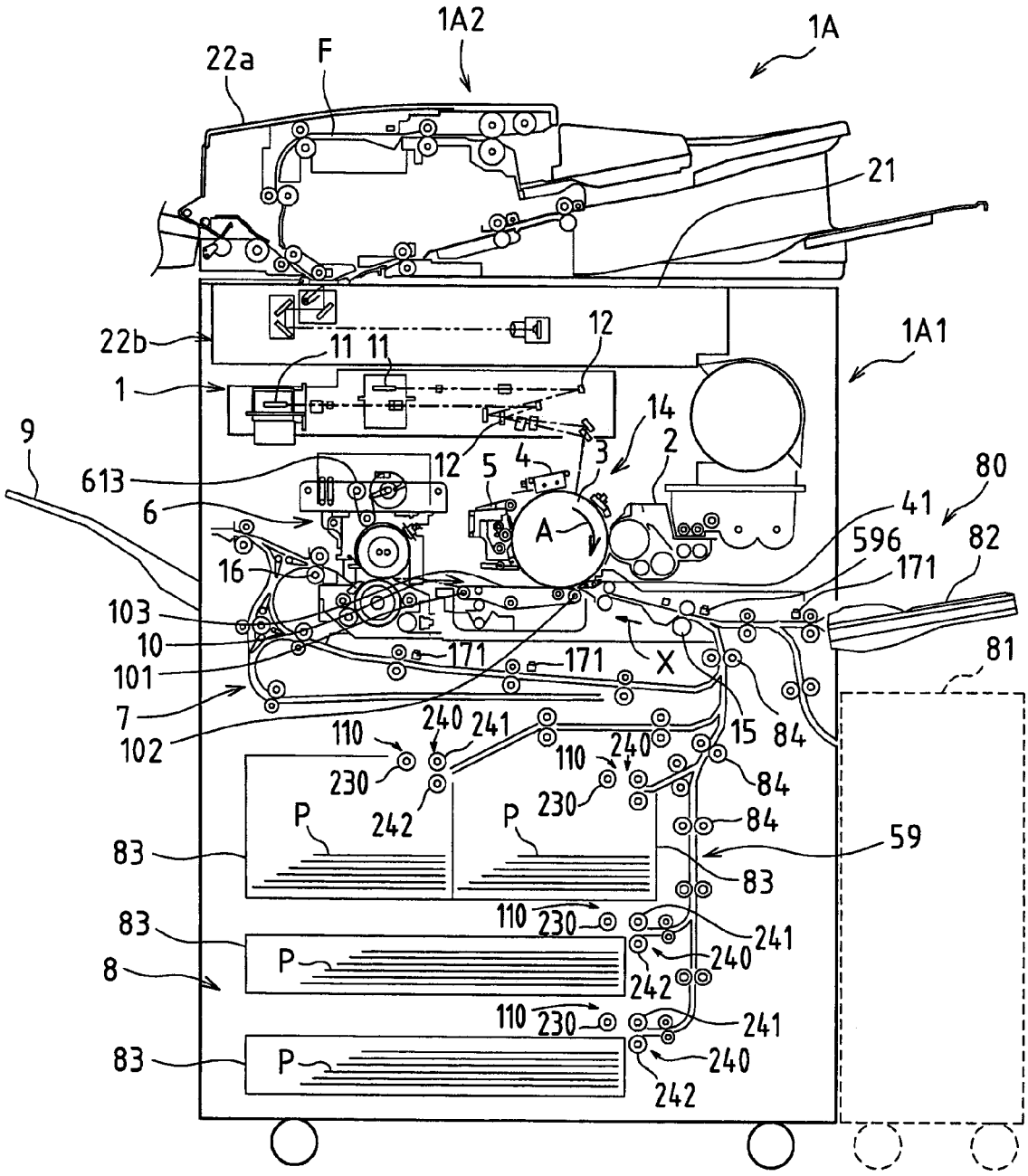
FIG. 1 is a diagram showing an image forming apparatus provided with a paper feeding device according to one embodiment of the present invention and is a diagram for describing an overall configuration of the image forming apparatus.
Figure 2:
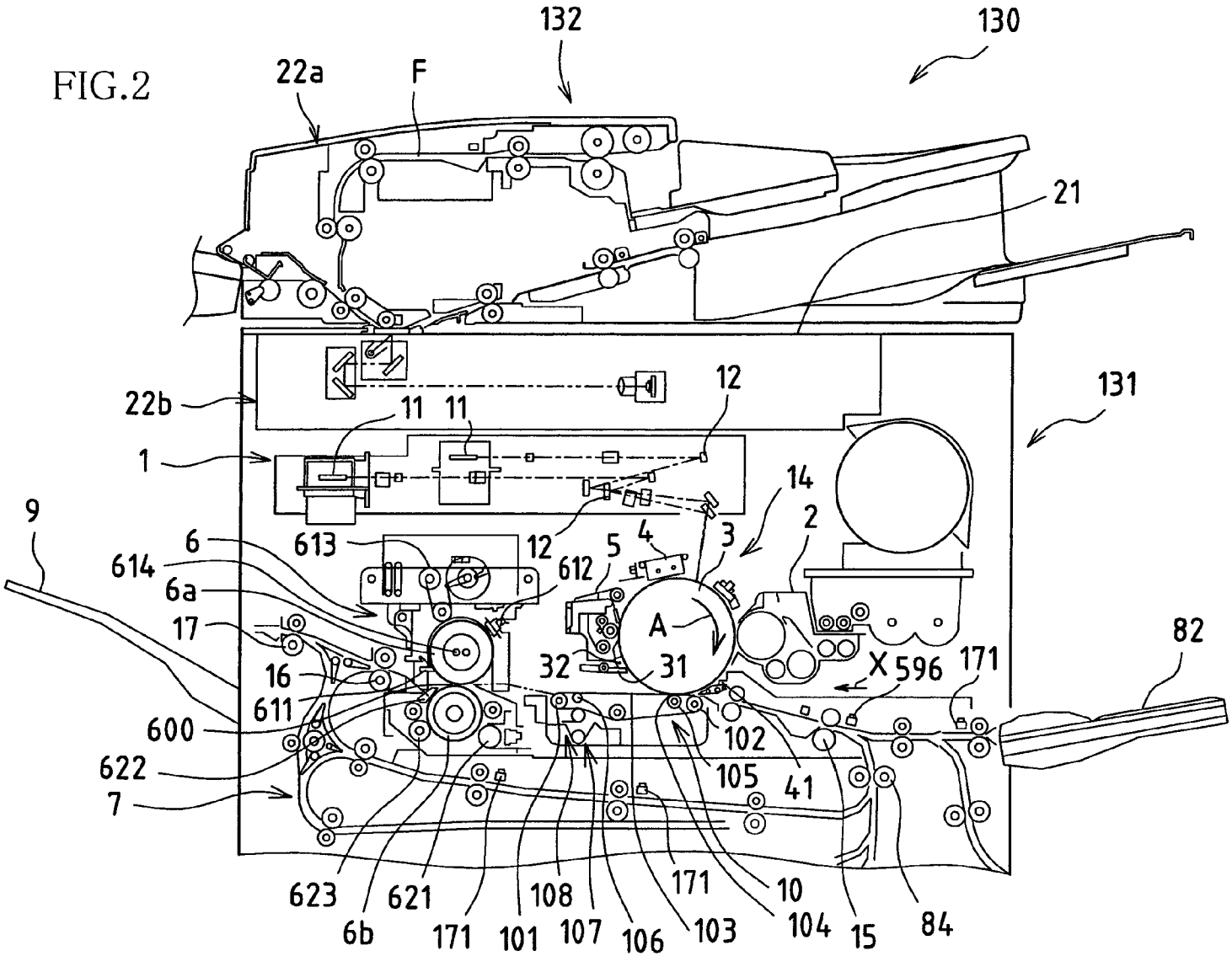
FIG. 2 is a detailed partial view showing an image forming apparatus provided with a paper feeding device according to one embodiment of the present invention.

First, description is given regarding the overall configuration of an image forming apparatus 130 with reference to FIG. 1 and FIG. 2. The image forming apparatus 130 shown in FIG. 1 forms images using an electrophotographic image forming process. The image forming apparatus 130 according to an illustrated example is provided with a photosensitive drum 3 that is an image carrier, a charging unit 4 for charging a surface of the photosensitive drum 3, an exposing unit 1 that is an exposing device for forming an electrostatic latent image on the photosensitive drum 3, a development unit 2 for forming a toner image on the photosensitive drum 3 by developing the electrostatic latent image using a developer, a transfer unit 10 that is a transfer device for transferring the toner image on the photosensitive drum 3 to a sheet such as a recording paper (hereinafter referred to as a paper) P, a fixing unit 6 that is a fixing device for fixing the transferred image on the paper P to the paper P, a cleaning unit 5 that is a cleaning device for removing residual toner that has not been transferred by the transfer unit 10 and remains on the surface of the photosensitive drum 3, a charge removal device 41 for neutralizing the charge on the photosensitive drum 3, and a main control unit 54 (not shown in FIG. 1, see FIG. 3, which is described later).

Specifically, the image forming apparatus 130 forms a monochrome (or single color) image on the paper P in accordance with image data read from an original or image data received from an external device not shown. Broadly divided, the configuration of the image forming apparatus 130 is constituted by an apparatus main unit 131 and an automatic document processing device 132. The apparatus main unit 131 is provided with an image forming unit 14, a paper transport path 59, a paper transport unit 7, and a paper feeding unit 8.

An original stage 21 constituted by transparent glass where originals are placed is provided at an upper surface portion of the apparatus main unit 131, and the automatic document processing device 132 is provided above the original stage 21 so as to readily swing open upwards.

The automatic document processing device 132 is provided with an automatic document feeding device 22*a* that transports originals (not shown in drawings) along an original transport path F and a scanner unit 22*b* that acts as an original reading portion that reads image information of an original that has been transported in or an original that has been positioned.

The image forming unit 14 and a paper discharge unit (herein, a discharge tray) 9 are arranged below the scanner unit 22*b*, and below that is arranged the paper feeding unit 8, which accommodates a plurality of papers P.

The image forming unit 14 is for recording an image onto the paper P based on the image data, and is provided with the aforementioned photosensitive drum 3, the charging unit 4, the exposing unit 1, the development unit 2, the transfer unit 10, the charge removal device 41, the cleaning unit 5, and the fixing unit 6.

Here, the photosensitive drum 3 is presented as cylindrical in shape, arranged below the exposing unit 1, and is rotated in a predetermined direction (direction of arrow A in the diagrams) by a drive means (not shown). Along an outer circumferential surface of the photosensitive drum 3 and toward a downstream side of the rotation direction A of the photosensitive drum, using as a reference the positioning after completion of image transfer, are arranged a paper separation claw 31, the cleaning unit 5, the charging unit 4 that acts as an electric field generating portion, the development unit 2, and the charge removal device 41 in this order.

The paper separation claw 31 is arranged so as to be capable of being brought into and out of contact with the outer circumferential surface of the photosensitive drum 3 by a solenoid 32. When it has been brought in contact with the outer circumferential surface of the photosensitive drum 3, the paper separation claw 31 separates any paper P that has become stuck to the surface of the photosensitive drum 3 when the unfixed toner image on the photosensitive drum 3 is transferred to the paper P.

It should be noted that instead of the solenoid 32, a drive motor or the like may also be employed as a drive means of the paper separation claw 31, and it is also possible to select other drive means.

The charging unit 4 acts as a charging means for uniformly charging the surface of the photosensitive drum 3 to a predetermined electric potential and is arranged above the photosensitive drum 3 in close proximity to the outer circumferential surface thereof. In the present embodiment, the charging unit 4 is a charger type component. It should be noted that the charging unit 4 may also be a roller type or brush type unit that makes contact with the photosensitive drum 3.

In the present embodiment, the exposing unit 1 is a laser scanning unit (LSU) provided with two laser irradiation portions 11, and two mirror groups 12. The exposing unit 1 launches laser light in response to the image data (i.e., image information for printing), which is outputted from an image processing unit 57 (not shown in FIG. 1 and FIG. 2, see FIG. 3), from the laser irradiation portions 11 respectively. Furthermore, the exposing unit 1 irradiates laser light from the laser irradiation portions 11 via the mirror groups 12 respectively onto the photosensitive drum 3 to expose the surface of the photosensitive drum 3, which has been charged uniformly by the charging unit 4, and in this way an electrostatic latent image is formed on the surface of the photosensitive drum 3.

In the present embodiment, the exposing unit 1 employs a two beam system provided with the two laser irradiation portions 11 to support high speed image forming processing, which enables the load to be decreased along with faster irradiation timings. It should be noted that instead of the laser scanning unit, an EL writing head or an LED writing head in which light-emitting elements are lined up in an array may be used as the exposing unit 1.

The development unit 2 supplies toner to the surface of the photosensitive drum 3 to develop the electrostatic latent image and form a toner image on the surface of the photosensitive drum 3. The development unit 2 is arranged substantially horizontally (on the right side in the diagrams) on a downstream side from the charging unit 4 in the rotation direction A of the photosensitive drum 3 in close proximity to the photosensitive drum 3.

By applying from the transfer unit 10 an electric field of an opposite polarity to the charge of the electrostatic latent image, which has been made a manifest image on the photosensitive drum 3, to the paper P that is transported in, the toner image on the photosensitive drum 3 is transferred onto the paper P.

In the present embodiment, the transfer unit 10 is provided with a transfer belt 103, a drive roller 101, an idler roller 102, and an elastic conductive roller 105. The transfer belt 103 spans the rollers 101, 102, and 105. The transfer unit 10 is arranged below the photosensitive drum 3 such that the surface of the transfer belt 103 touches a portion of the outer circumferential surface of the photosensitive drum 3. Due to the transfer belt 103, the paper P is pressed against the photosensitive drum 3 while being transported.

Specifically, the surface of the transfer belt 103 moves due to rotation of the rollers 101, 102, and 105, thereby transporting the paper P that has been placed on that surface. The transfer belt 103 has a predetermined resistance value, for example, $1\times10^{9}$ to $1\times10^{13}$ Ω/cm. The elastic conductive roller 105, to which can be applied a transfer electric field of a different conductivity to the drive roller 101 and the idler roller 102, is arranged at a contact area 104 between the photosensitive drum 3 and the transfer belt 103. The elastic conductive roller 105 presses against the surface of the photosensitive drum 3 through the transfer belt 103. Due to this, the paper P on the surface of the transfer belt 103 can be pressed against the surface of the photosensitive drum 3.

The transfer electric field having an opposite polarity to the charge of the toner image on the surface of the photosensitive drum 3 is applied to the elastic conductive roller 105. Due to this transfer electric field of an opposite polarity, the toner image on the surface of the photosensitive drum 3 can be transferred to the paper P on the transfer belt 103. For example, when the toner image has a charge of a negative (−) polarity, the polarity of the transfer electric field applied to the elastic conductive roller 105 is a positive (+) polarity.

In this transfer unit 10, the elastic conductive roller 105 is constituted by a soft material such as elastic rubber or a foam resin or the like. Due to the elasticity of the elastic conductive roller 105, the photosensitive drum 3 and the transfer belt 103 do not make line contact, but rather make surface contact having a predetermined width 104 which is referred to as a so-called transfer nip. Due to this, the transfer efficiency onto the transported paper P can be improved.

Further still, at a downstream side in the paper transport direction (arrow X direction in the diagrams) from the transfer region of the transfer belt 103, a neutralizing roller 106 is arranged touching a rear surface of the transfer belt 103 (a surface on an opposite side from the surface where the papers P are transported). The neutralizing roller 106 neutralizes the electric field that has been applied to the transported paper P at the transfer region and ensures that transport to subsequent processing is carried out smoothly. Furthermore, a neutralizing mechanism 108 is arranged at the transfer unit 10. The neutralizing mechanism 108 carries out neutralization on a belt cleaning unit 107, which removes toner from the transfer belt 103, and on the transfer belt 103. A technique of performing grounding via the apparatus or a technique of actively applying an opposite polarity to the polarity of the transfer electric field are available as techniques that can be used for carrying out neutralization in the neutralizing mechanism 108.

The electrostatic image that is transferred to the paper P by the transfer unit 10 is transported to the fixing unit 6 where it undergoes pressure and heating such that the unfixed toner melts and becomes fixed onto the paper P to form an image.

The fixing unit 6 applies heat and pressure to the paper P to thermally fix the toner image to on the paper P. Specifically, the fixing unit 6 is provided with a hot roller **6*a* and a pressure roller 6*b*, and the hot roller 6*a* is rotated while the paper P is being sandwiched by the hot roller 6*a* and the pressure roller 6*b* so as to pass between the hot roller 6*a* and the pressure roller 6*b***, thereby melting and fixing the toner image that had been transferred to the paper P.

Transport rollers 16 that transport the paper P are arranged on a downstream side in the paper transport direction X of the fixing unit 6.

A paper separation claw 611, a roller surface temperature detection member (thermistor) 612, and a roller surface cleaning member 613 are arranged on an outer circumferential surface of the hot roller **6*a*. A heat source 614 is provided on an inner side of the hot roller 6*a* in order to heat the surface of the hot roller 6*a* to a predetermined temperature (fixing temperature: approximately 160° C. to 200° C.). Furthermore, a pressure-applying member not shown in the drawings is arranged at both ends of the pressure roller 6*b* so that the pressure roller 6*b* is pressed into contact with the hot roller 6*a* with a predetermined pressure. A pressure-applying member 621 capable of pressing the pressure roller 6*b* against the hot roller 6*a* with a predetermined amount of pressure is arranged at both ends of the pressure roller 6*b*, and further still, a paper separation claw 622 and a roller surface cleaning member 623 are arranged on an outer circumferential surface of the pressure roller 6*b* in the same manner as the outer circumferential surface of the hot roller 6*a***.

When the paper P is transported to a pressing portion 600, which is referred to as a so-called fixing nip portion, between the hot roller **6*a* and the pressure roller 6*b*, the fixing unit 6 subjects the unfixed toner image on the paper P to thermal melting and pressure while the paper P is being transported by the rollers 6*a* and 6*b***. Due to this, the unfixed toner image can be fixed onto the paper P.

The charge removal device 41 serves as a pre-transfer neutralizing means for reducing the surface electric potential of the photosensitive drum 3 so that the toner image formed on the surface of the photosensitive drum 3 is easily transferred to the paper P. The charge removal device 41 is arranged on a downstream side from the development unit 2 in the rotation direction A of the photosensitive drum in close proximity to the photosensitive drum 3.

It should be noted that in the present embodiment, the charge removal device 41 is configured using a neutralizing electrode, but a neutralizing lamp may be used instead of a neutralizing electrode, and it is also possible to perform neutralization using other methods.

The cleaning unit 5 removes and collects toner that is residual on the surface of the photosensitive drum 3 after development and transfer. The cleaning unit 5 is arranged substantially horizontally (left side in the diagrams) lateral to the photosensitive drum 3 in a position substantially opposing the development unit 2 sandwiching the photosensitive drum 3.

The paper transport path 59 guides the paper P from a paper housing unit 80 in the paper feed unit 8 to the image forming unit 14. Specifically, a plurality of pairs of transport rollers 84 and a pair of registration rollers 15 are provided on the paper transport path 59 in order to transport the paper P. The pair of registration rollers 15 are operated by an unshown drive means so as to transport the papers P from the plurality of pairs of transport rollers 84 between the photosensitive drum 3 and the transfer belt 103 in synchronization with the electrostatic latent image on the photosensitive drum 3. The pair of registration rollers 15 is arranged on an upstream side from the photosensitive drum 3 in the paper transport direction X and on a downstream side from the plurality of pairs of transport rollers 84.

In the present embodiment, the paper housing unit 80 and paper feeding devices 110 are provided in the paper feeding unit 8. The paper housing unit 80 is constituted by a large capacity cassette (LCC) 81, a manual feeding tray 82, and a plurality of paper feeding trays 83. The plurality of pairs of transport rollers 84 in the paper transport path 59 are configured to take in the papers P from the paper feed trays 83 using the paper feeding devices 110, and transport the paper P until a leading edge portion of the paper P reaches the registration rollers 15. That is, the plurality of pairs of transport rollers 84 are configured to transport the paper P such that the leading edge portion of the paper P reaches and contacts the registration rollers 15, which are temporarily stopped, until the paper P bends there. Due to an elastic force of the bent paper P, the leading edge portion of the paper P can be aligned parallel to the registration rollers 15. After this, due to the registration rollers 15 being rotationally driven, the paper P is transported to the transfer unit 10 of the image forming unit 14.

The paper transport unit 7 is configured such that the paper P, which has undergone image forming by the image forming unit 14, is transported by discharge rollers 17 to the discharge tray 9.

It should be noted that paper detection sensors 171 constituting paper transport detection devices 170 (not shown in FIG. 1 and FIG. 2, see FIG. 3) that detect a position or the like of the papers P are arranged in various locations in the paper transport unit 7. In this way, the plurality of pairs of the transport rollers 84 and the registration rollers 15 undergo drive control in accordance with positions of the papers P detected by the various sensors such that the papers P undergo transport and positioning control.

The paper feeding devices 110 are provided corresponding to the plurality of paper feeding trays 83 that constitute the paper housing unit 80.

The paper feeding trays 83 are components for accumulating multiple sheets of the papers P on which image information has been outputted, that is printed, and are mounted on the paper feeding unit 8 below the image forming unit 14.

Since an object of the image forming apparatus 130 in the present embodiment is high speed image forming, each of the paper feeding trays 83 ensures a capacity capable of storing from 500 to 1,500 sheets of standard size papers P such as A4, A3, B4, and the like.

Also, the large capacity cassette (LCC) 81 and the manual feeding tray 82 are provided on a lateral surface of the image forming apparatus 130. The large capacity cassette 81 is capable of housing a large amount of multiple types of papers P. The manual feeding tray 82 is mainly for supplying non-standard sizes and/or small amounts of the papers P.

The discharge tray 9 is arranged at a lateral surface of the image forming apparatus 130 on an opposite side to the manual feeding tray 82. Instead of the discharge tray 9, the image forming apparatus 130 can be configured such that post processing devices for discharged papers or a plurality of levels of discharge trays are arranged as options. Post processing devices for discharged papers include, for example, post processing devices for stapling, punching or the like.

In the above-described image forming apparatus 130, the papers P that are supplied from the paper housing unit 80 are transported sheet by sheet by the paper transport unit 7 between the photosensitive drum 3 and the transfer unit 10, and the toner image that has been formed on the photosensitive drum 3 is transferred to the paper P. Then, the unfixed toner image is fixed to the paper P by the fixing unit 6. After this, the paper P on which the toner image has been fixed is processed in accordance with a specified processing mode and discharged to the discharge tray 9.

Control System of Image Forming Apparatus

Figure 3:
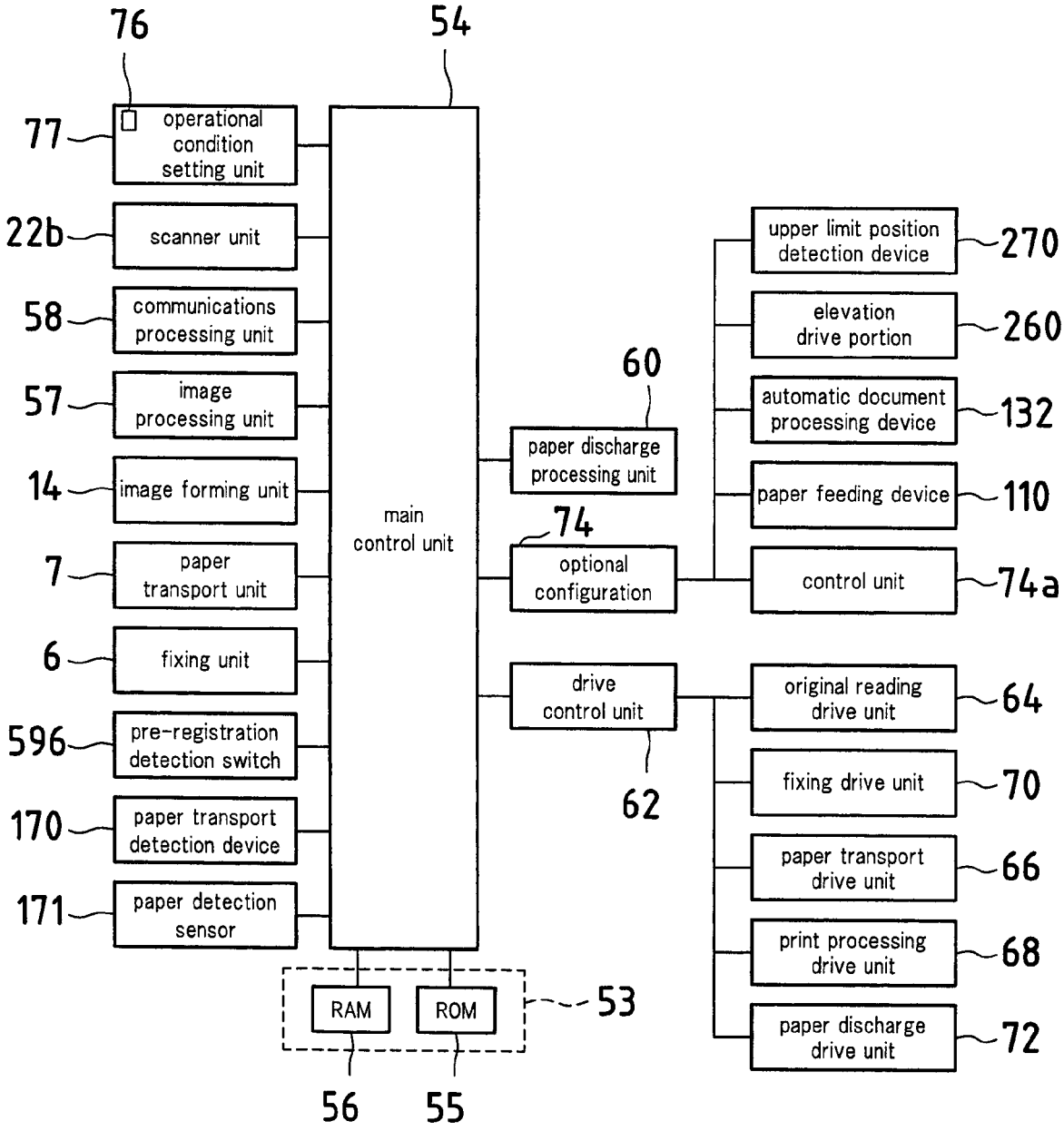
FIG. 3 is a block diagram that schematically shows a control configuration of the image forming apparatus shown in FIG. 1 and FIG. 2.

Next, description is given regarding a control system of the image forming apparatus 130 shown in FIG. 1 and FIG. 2 with reference to FIG. 3. FIG. 3 is a block diagram that schematically shows a control configuration of the image forming apparatus 130 shown in FIG. 1 and FIG. 2.

The main control unit 54 provided in the image forming apparatus 130 controls overall operations of the image forming apparatus 130. As shown in FIG. 3, for example, the main control unit 54 is constituted by a central processing unit such as a CPU or the like, and is connected to a storage unit 53. The storage unit 53 includes semiconductor memories such as a ROM (read only memory) 55 and a RAM (random access memory) 56.

The ROM 55 stores control programs, which are procedures for processing to be executed by the main control unit 54. The RAM 56 provides a work area for operations.

The main control unit 54 uses a temporary storage means such as the RAM 56 to execute processing such as image reading processing, image processing, image forming processing, and transport processing for the papers P in accordance with programs stored in advance in the ROM 55.

It should be noted that storage means such as a HDD (hard disk drive) can be used instead of semiconductor memories such as the ROM 55 and the RAM 56.

In the image forming apparatus 130, image information, i.e. original image data, of the original read by the scanner unit 22*b*, or original image information that has been sent from any of various terminal devices that are connected by an unshown communications network is inputted to the image processing unit 57 via a communications processing unit 58.

The image processing unit 57 uses the aforementioned programs to process the original image information stored in the storage unit 53 such as the RAM 56 into image information for printing suited to image forming onto the papers P by printing. The image information for printing is inputted to the image forming unit 14.

The image forming unit 14, the paper transport unit 7 that carries out various types of detection and control of the papers P in the paper transport path 59 or the like, the fixing unit 6 and a paper discharge processing unit 60 that carries out various types of detection and control of the papers P in the discharge rollers 17 work in cooperation with a drive control unit 62.

Through a printing process that is print processing of the image information in the image forming unit 14 and thereafter the fixing unit 6 that carries out a fixing process on the paper that has undergone the print processing, the paper P that is transported by the paper transport unit 7 is discharged to the discharge tray 9, which is a paper discharge portion.

It should be noted that in the paper transport unit 7, detection signals of a pre-registration detection switch 596, the paper detection sensors 171, an unshown fixing detection switch, and a discharge detection switch and the like are inputted to an input system of the main control unit 54.

The pre-registration detection switch 596 is a switch that detects whether or not the paper P has reached the registration rollers 15. The fixing detection switch is a switch that detects whether or not the paper P has reached the fixing unit 6. The discharge detection switch is a switch that detects whether or not the paper P has been discharged. Furthermore, a transport status of the paper P transported on the paper transport path 59 is detected by the paper detection sensors 171.

And the main control unit 54 is configured to carry out timing control of members such as motors, solenoids, and lamps and the like that are connected to its output system based on input signals from members such as various sensors and switches and the like connected to its input system.

Furthermore, an operational condition setting unit 77 is provided in the image forming apparatus 130. The operational condition setting unit 77 is for setting operational conditions such as image forming or transport conditions of the image forming apparatus 130 in response to image forming requests set by a user using various operating switches 76 or image forming conditions of various types of papers P.

Furthermore, the image forming apparatus 130 carries out operations of an original reading drive unit 64, a paper transport drive unit 66, a print processing drive unit 68, a fixing drive unit 70, and a paper discharge drive unit 72 using the control of the drive control unit 62 in accordance with the operating conditions that have been set. These operations are carried out in synchronization in accordance with instructions of the main control unit 54 based on the programs stored in the ROM 55.

The original reading drive unit 64 is an actuator for driving the scanner unit 22*b*. The paper transport drive unit 66 is an actuator for driving the paper transport unit 7 and here is a motor for driving the paper transport unit 7. More specifically, the paper transport drive unit 66 is a motor for driving an uptake member 230, which is described later, the plurality of pairs of the transport rollers 84, and the registration rollers 15 of the paper feeding devices 110, which are described later, arranged on a paper transport direction X upstream side from the paper transport path 59. The print processing drive unit 68 is an actuator for driving the image forming unit 14 and here is a motor for driving the photosensitive drum 3. The fixing drive unit 70 is an actuator for driving the fixing unit 6 and here is a motor for driving the hot roller 6*a* and the pressure roller 6*b* of the fixing unit 6.

The paper discharge drive unit 72 is an actuator for driving the paper discharge processing unit 60 and here is a motor for driving the discharge rollers 17 and the like.

The drive motors of these drive units can be configured using an appropriate power transmission mechanism, using as a drive source the same or different motors.

Further still, post processing devices such as stapling devices, punching devices, multilevel discharge trays, shifters, and the like, and automatic original reading devices such as the automatic document processing device 132 or the like can be arranged as optional configurations 74 for the image forming apparatus 130. These optional configurations 74 are configured to have their timings adjusted to be in synchronization with the image forming apparatus 130 via the communications processing unit 58 while having their own control units 74*a* inside the optional configurations 74 separate from the main control unit 54 of the image forming apparatus 130.

Paper Feeding Device Configuration

Next, description is given regarding the paper feeding devices 110 according to an embodiment of the present invention with reference to the diagrams. It should be noted that here description is given using an example of a case in which a paper feeding device 110 has been applied to a paper feeding tray 83 within the paper housing unit 80.

Figure 4A:
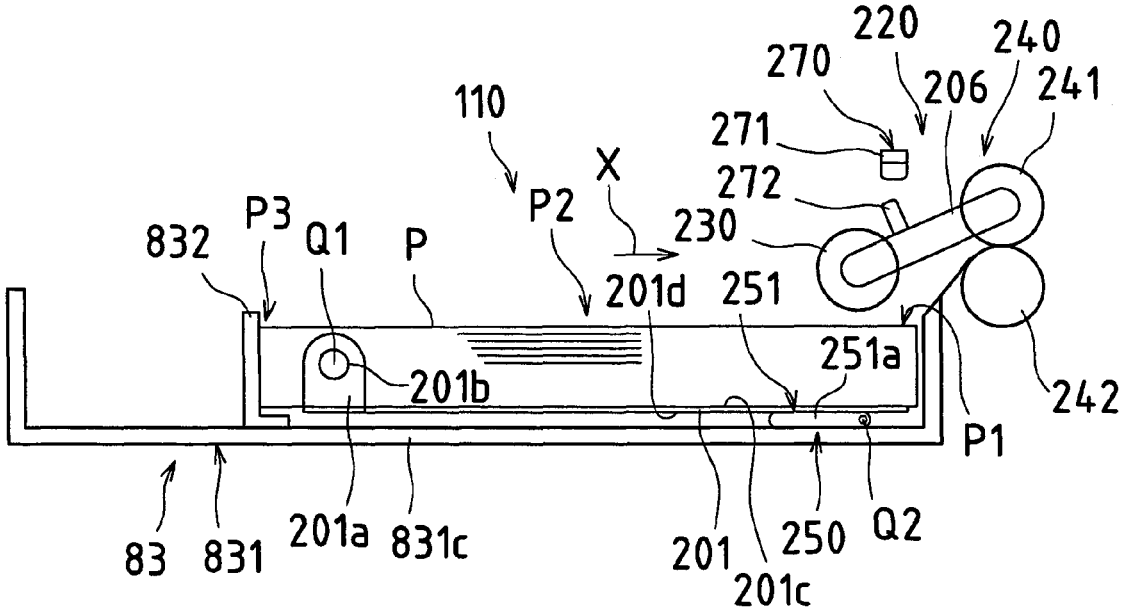
FIG. 4A and FIG. 4B are diagrams for describing a paper feeding device according to one embodiment of the present invention and an outline configuration of a paper feeding tray.
Figure 4B:
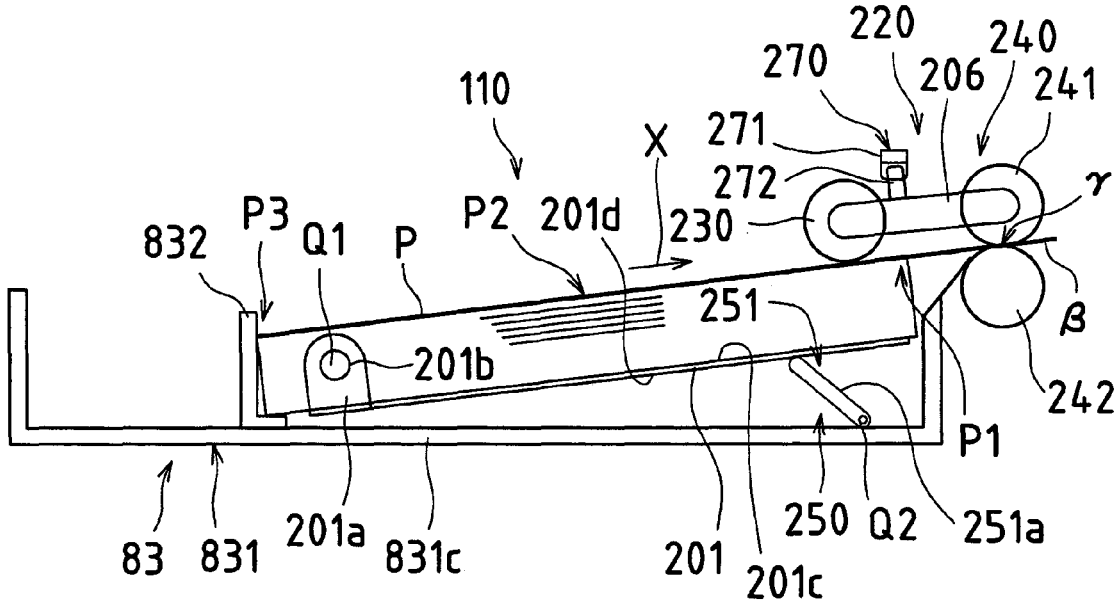
Figure 5A:
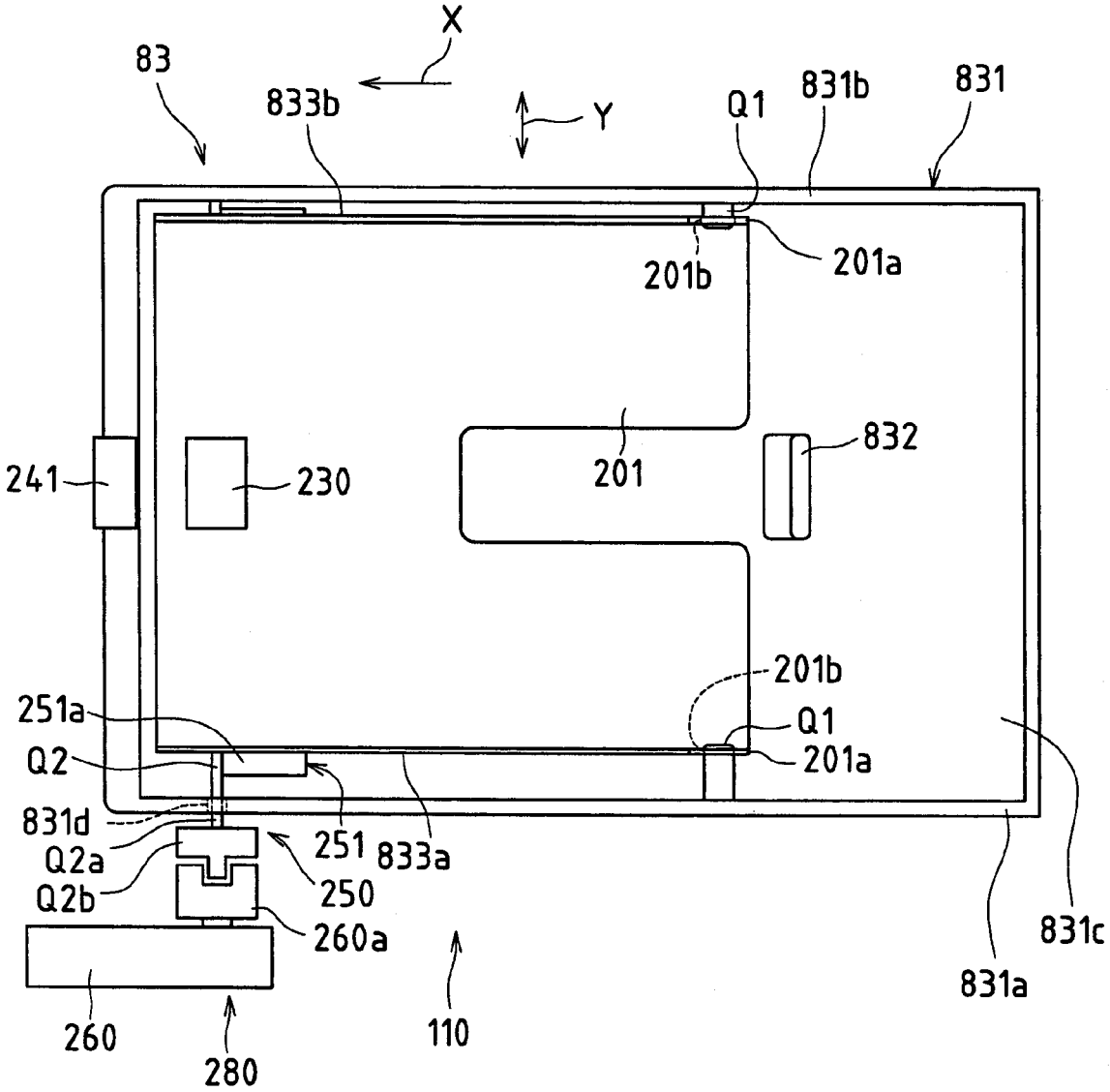
FIG. 5A and FIG. 5B are diagrams for describing the outline configuration of the paper feeding device and the paper feeding tray shown in FIG. 4A and FIG. 4B.
Figure 5B:
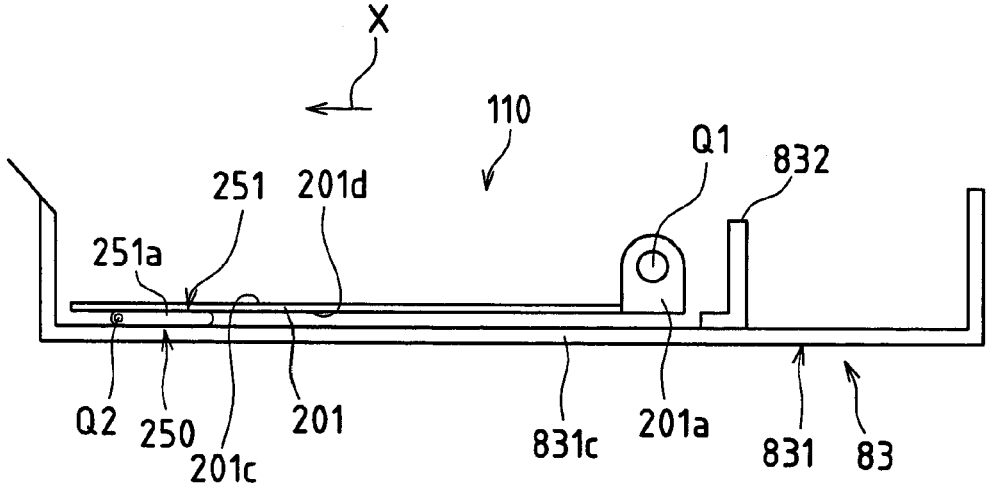

FIG. 4A and FIG. 4B illustrate an outline configuration of a paper feeding device 110 according to an embodiment of the present invention and a paper feeding tray 83 provided with this. FIG. 5A and FIG. 5B illustrate an outline configuration of a paper feeding device 110 and a paper feeding tray 83 provided with this. It should be noted that an upper limit position detection device 270 shown in FIG. 4A and FIG. 4B is omitted in FIG. 5A and FIG. 5B. In addition, a pickup roller 230 and a paper feeding roller 241 shown in FIG. 4A and FIG. 4B are omitted in FIG. 5B. Also, a roller belt 244, which will be described later, is not shown in these diagrams.

The paper feeding tray 83 is provided with a housing container 831 that houses papers P, a first restraining member 832 that restrains the papers P housed in the housing container 831 from moving backward from a rear end portion P3, and second restraining members 833*a* and 833*b* that restrain a position of the papers P housed in the housing container 831 in a horizontal direction (arrow Y direction in FIG. 5A) orthogonal to the paper transport direction X. The rear end portion P3 of the paper P refers to an upstream side edge portion in the transport direction X of the paper P.

The paper feeding device 110 is provided with a loading member 201. The loading member 201 is capable of being loaded with a plurality of the papers P.

In the present embodiment, the loading member 201 is capable of being loaded with a plurality of the papers P and is capable of elevating vertically at least a leading edge portion P1 in the paper transport direction X. The illustrated loading member 201 is configured as a rotating board 201*c* rotatable around an axis along a direction Y orthogonal to the transport direction X of the paper P. The housing container 831 and the loading member 201 (herein, rotating board 201*c*) are both rectangular as viewed from above. The rotating board 201*c* is housed inside the housing container 831.

The paper feeding device 110 is further provided with a paper feeding mechanism 220. The paper feeding mechanism 220 is provided with the pickup roller 230 for pulling out the uppermost positioned paper P loaded in the rotating board 201*c* and housed in the paper feeding tray 83, a separation transport mechanism 240 for transporting sheet by sheet the papers P that have been pulled out by the pickup roller 230, an elevating device 280 that vertically elevates at least the leading edge portion P1 of the rotating board 201*c*, and the upper limit position detection device 270 that detects an upper limit position of the rotating board 201*c*.

In the present embodiment, the elevating device 280 is provided with an elevating mechanism 250 that vertically elevates the leading edge portion P1 of the rotating board 201*c* on a rotation shaft Q1 arranged along the direction Y orthogonal to the paper transport direction X, and an elevation drive portion 260 that drives the elevating mechanism 250. The elevation drive portion 260 here is an actuator for elevation driving such as a lift-up motor or the like. And the paper feeding device 110 uses the drive of the elevation drive portion 260 to sequentially pull out (pick up) with the pickup roller 230 the uppermost positioned paper P among the papers P placed in the rotating board 201*c*, which has been raised by the elevating mechanism 250 and sort the paper P using the separation transport mechanism 240, thereby performing sheet by sheet supply to the paper transport path 59.

The pickup roller 230 is arranged above the paper discharge (paper P leading edge portion P1) side of the paper feeding tray 83. The separation transport mechanism 240 is provided with the paper feeding roller 241 arranged at an upper surface side of the paper P pulled out by the pickup roller 230 and a separation member in opposition to the paper feeding roller 241. A separation roller 242 is provided here as the separation member.

Specifically, the pickup roller 230 readily swivels on an axis of the paper feeding roller 241. Furthermore, the pickup roller 230 is rotationally driven in the same direction as the paper feeding roller 241. And a transport guide member 206 is provided between the pickup roller 230 and the paper feeding roller 241 to smoothly guide the paper P from the pickup roller 230 to the paper feeding roller 241. The transport guide member 206 readily swivels on an axis of the paper feeding roller 241 and supports the pickup roller 230 to readily rotate on an axis. The more detailed configuration of the pickup roller 230, paper feeding roller 241 and the like will be described later.

The rotating board 201*c* is supported to readily rotate on the rotation shaft Q1 at support members 831*a* and 831*b* (see FIG. 5A) at edge portions on an opposite side from the paper discharge side of the rotating board 201*c*.

Specifically, the support members 831*a* and 831*b* are side panels on either side of the housing container 831 in the direction Y orthogonal to the paper transport direction X, and these side panels 831*a* and 831*b* support the rotation shafts Q1 respectively. The rotating board 201*c* has engaging fulcrum portions 201*a* that extend upward at side edge portions in the direction Y orthogonal to the paper transport direction X at side edge portions opposite the paper discharge side. Pass-through holes 201*b* that pass through in the direction Y orthogonal to the paper transport direction X are arranged on the engaging fulcrum portions 201*a*. And the rotation shafts Q1 insert into the pass-through holes 201*b* to readily rotate on their axes. In this way, the rotating board 201*c* is supported by the side panels 831*a* and 831*b* via the rotation shafts Q1 to readily rotate on the rotation shafts Q1.

The elevating mechanism 250 is provided with an elevating member 251 that vertically elevates the rotating board 201*c* at the paper discharge side through rotation on the rotation shafts Q1.

Specifically, the elevating member 251 is provided with a rotation shaft Q2 arranged along the direction Y orthogonal to the paper transport direction X and a rotation portion 251*a* that is supported on this rotation shaft Q2, and is arranged between the rotating board 201*c* and a bottom panel 831*c* of the housing container 831. The rotation shaft Q2 is supported to readily rotate on its axes at the side panels 831*a* and 831*b* of the housing container 831. Furthermore, the rotation shaft Q2 has a protruding portion Q2*a* that protrudes outwardly from the side panel 831*a* on one side of the housing container 831. That is, a pass-through hole 831*d* that passes through in the direction Y orthogonal to the paper transport direction X is arranged on the side panel 831*a* on one side of the housing container 831. And the rotation shaft Q2 inserts into the pass-through holes 831*d* to readily rotate on it axis.

Furthermore, an engaging portion Q2*b* that engages with a movable portion 260*a* of the elevation drive portion 260 is provided so as to disable relative rotation to the protruding portion Q2*a* of the rotation shaft Q2. It should be noted that at least one of the engaging portion Q2*b* of the rotation shaft Q2 and the movable portion 260*a* of the elevation drive portion 260 readily moves along the rotation shaft Q2 and applied with a biasing force to the other side. And when mounting or after mounting the engaging portion Q2*b* of the rotation shaft Q2 and the movable portion 260*a* of the elevation drive portion 260 to the paper feeding unit 8 of the paper feeding tray 83, by rotating the movable portion 260*a* with the engaging portion Q2*b* and the movable portion 260*a* engaging with each other in a concavo-convex manner, the engaging portion Q2*b* rotates accompanying rotation of the movable portion 260*a*.

The rotation portion 251*a* is provided extending toward an outer side in a diameter direction of the rotation shaft Q2 at one portion of the circumferential direction of the rotation shaft Q2. By contacting and sliding along a bottom surface 201*d* of the rotating board 201*c* due to the axial rotation of the rotation shaft Q2, the rotation portion 251*a* is capable of achieving a lowered posture, in which the rotating board 201*c* is in a parallel state with the bottom panel 831*c* of the housing container 831, and a raised posture, in which the paper discharge side of the rotating board 201*c* rises to put the rotating board 201*c* into a tilted state. And by causing the rotation shaft Q2 to rotate by the movable portion 260*a* via the engaging portion Q2*b*, the elevation drive portion 260 is capable of vertically elevating the rotating board 201*c* by the rotation portion 251*a* on the rotation shafts Q1 on the paper discharge portion side.

The upper limit position detection device 270 is provided with a first detection member 271, which is secured in a predetermined position, and a second detection member 272, which is installed at a portion that elevates due to the driving of the elevation drive portion 260. The first and second detection members 271 and 272 are put into a detection state (herein, an ON state) by movement of the second detection member 272 accompanying the driving of the elevation drive portion 260, thereby making the upper limit position detection device 270 capable of detecting a predetermined standard upper limit position of the rotating board 201*c*. Here, the standard upper limit position refers to a position at which a straight path β extending from the uppermost positioned regular and uncurled paper P loaded on the rotating board 201*c* along a surface of this uppermost position passes through a nip portion γ between the paper feeding roller 241 and the separation roller 242 (see FIG. 4B).

Here, the first detection member 271 is configured as a photosensor secured at a predetermined position on the paper feeding unit 8. Furthermore, the second detection member 272 is configured as a detection piece installed on the transport guide member 206 arranged between the pickup roller 230 and the paper feeding roller 241. By having the first detection member 271 detect the second detection member 272 due to the movement of the transport guide member 206 accompanying the raising of the rotating board 201*c*, the thus-configured upper limit position detection device 270 is capable of detecting that the rotating board 201*c* is positioned in the aforementioned standard upper limit position.

Due to this detection, the main control unit 54 is configured to stop operation of the elevation drive portion 260 and stop the raising of the rotating board 201*c*. It should be noted that the main control unit 54 is configured to, when there becomes fewer papers P on the rotating board 201*c* and the detection of the first detection member 271 by the second detection member 272 is cleared by the transport guide member 206 rotating downward, operate the elevation drive portion 260 of the elevating device 280 so that the rotating board 201*c* is raised to a position where the first and second detection member 271 and 272 are put into a detection state.

Description of Paper Feeding Device According to Present Embodiment

Figure 6A:
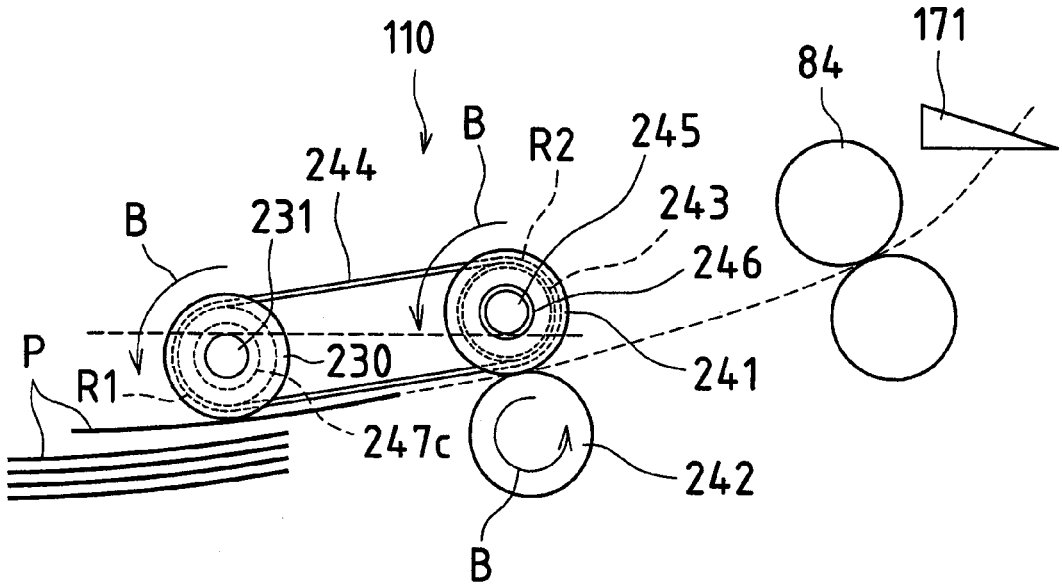
FIG. 6A to FIG. 6C are diagrams for describing an outline configuration of the paper feeding device according to one embodiment of the present invention.
Figure 6B:
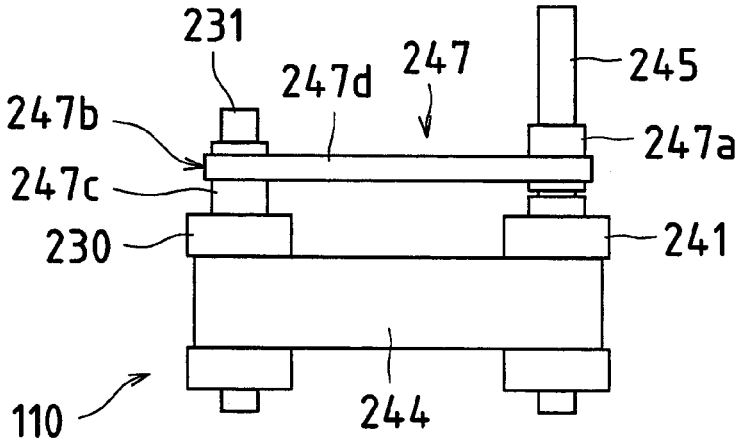
Figure 6C:
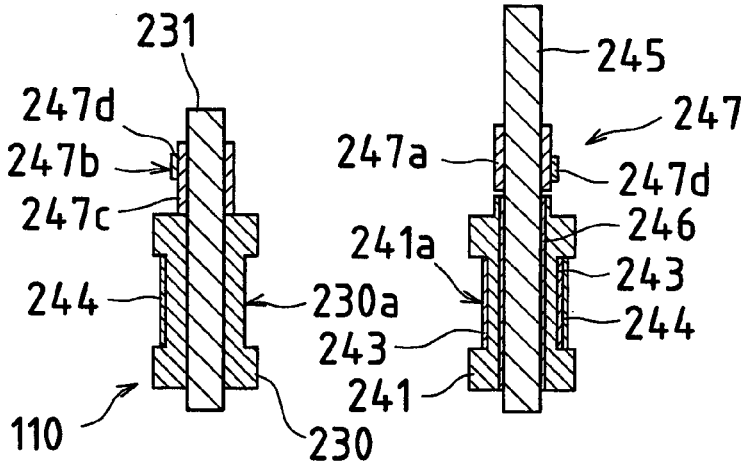
Figure 7A:
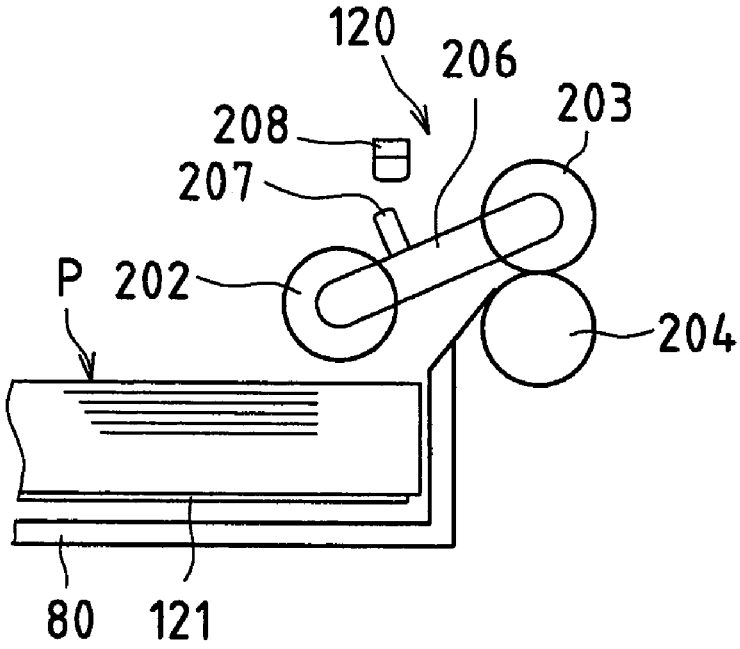
FIG. 7A and FIG. 7B are schematic views for describing a conventional paper feeding device provided with a pickup roller and a paper feeding roller.
Figure 7B:
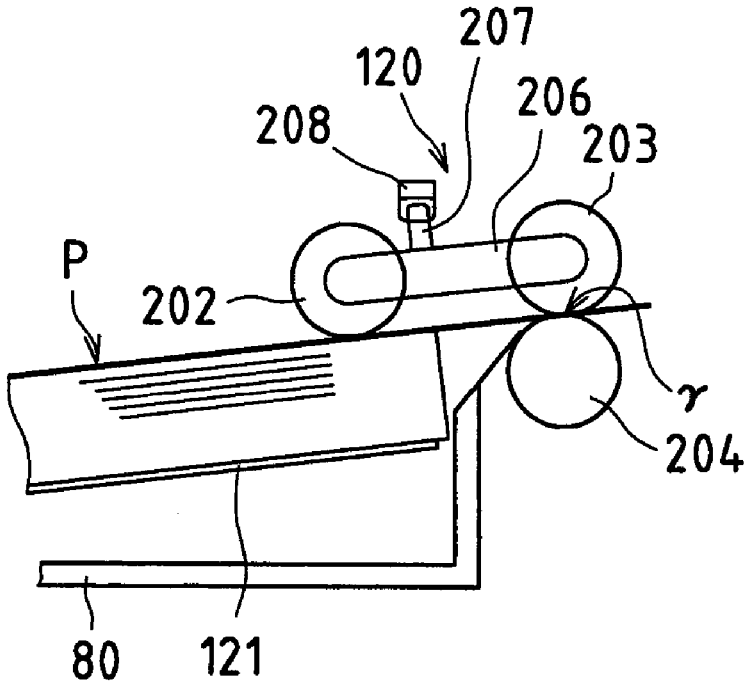

Next, description is given regarding a configuration of a paper feeding device 110 according to an embodiment of the present invention with reference to FIGS. 6A to 6C. It should be noted that the transport guide member 206 is omitted from FIGS. 6A to 6C.

The paper feeding device 110 is provided with an endless roller belt 244 that spans between the pickup roller 230 and the paper feeding roller 241 so as to readily move relatively in a circumferential direction with respect to an outer circumferential surface of the paper feeding roller 241. In other words, the outer circumferential surface of the paper feeding roller 241 and an inner circumferential surface of the roller belt 244 are disposed so as to readily move relatively together in the circumferential direction. In this way, rotation of the paper feeding roller 241 can be allowed even when rotation of the pickup roller 230 stops. And the roller belt 244 obtains rotational drive from the pickup roller 230.

In the present embodiment, the paper feeding device 110 is provided with a rotating roller 243 that is provided on a same axis as the paper feeding roller 241 and readily rotates relatively on the axis in an overlapping manner, and the roller belt 244 spans between the rotating roller 243 and the pickup roller 230. That is, in relation to the roller belt 244, the pickup roller 230 is a drive roller, and the rotating roller 243, which is provided so as to readily rotate on the same axis as the paper feeding roller 241, is an idler roller. It should be noted that a width of the rotating roller 243 is smaller than a width of the paper feeding roller 241.

Specifically, the main control unit 54 controls the drive timing from the paper transport drive unit 66 to a paper feeding shaft 245. Furthermore, the main control unit 54 is configured to control the drive timing from the paper transport drive unit 66 to post paper feeding transport rollers 84, which are a pair of transport rollers close to the paper feeding roller 241. And in carrying out paper feeding of the papers P loaded in the rotating board 201*c*, the main control unit 54 directs the commencement of driving to the paper feeding shaft 245 and the post paper feeding transport rollers 84, and thereafter, when a transport sensor 171 that detects paper transport of the post paper feeding transport rollers 84 detects the transport of a paper P by the post paper feeding transport rollers 84, the main control unit 54 directs a shutdown of drive to the paper feeding shaft 245.

The paper feeding roller 241 is coupled to the paper feeding shaft 245 via a one way coupling member 246 (hereinafter referred to as one way coupling). The one way coupling 246 couples the paper feeding roller 241 to the paper feeding shaft 245 when the paper feeding shaft 245 rotates in a rotational drive direction (paper P transport direction) B, thereby disabling relative rotation, but allows the paper feeding roller 241 to readily rotate in the rotational drive direction B when the rotation of the paper feeding shaft 245 stops. In this way, the paper feeding roller 241 is able to transport the paper P using the drive from the paper transport drive unit 66 to the paper feeding shaft 245, but after the shutdown of drive from the paper transport drive unit 66 to the paper feeding shaft 245, it is able to rotate idly at the paper P transported by the post paper feeding transport rollers 84 on the other side from the separation roller 242. It should be noted that the separation roller 242, which is arranged in opposition to the paper feeding roller 241, is able to be rotationally driven in the same direction B as the paper feeding roller 241 (an opposite direction to the paper P transport direction).

The pickup roller 230 is coupled to the paper feeding shaft 245 via a one way drive transmission mechanism 247. The one way drive transmission mechanism 247 couples the pickup roller 230 to the paper feeding shaft 245 when the paper feeding shaft 245 rotates in the rotational drive direction B, but allows the pickup roller 230 to readily rotate in the rotational drive direction B when the rotation of the paper feeding shaft 245 stops.

A one way mechanism may be arranged in any location between the paper feeding shaft 245 and the pickup shaft 231 for the one way drive transmission mechanism 247. Here, the one way drive transmission mechanism 247 is constituted by a one way coupling member 247*a* (hereinafter referred to as one way pulley) coupled to the paper feeding shaft 245 and a drive transmission member 247*b* that transmits driving force from the one way pulley 247*a* to the pickup roller 230.

The one way pulley 247*a* couples the pickup roller 230 to the paper feeding shaft 245 via the drive transmission member 247*b* when the paper feeding shaft 245 rotates in the rotational drive direction B, but allows the pickup roller 230 to readily rotate in the rotational drive direction B via the drive transmission member 247*b* when the rotation of the paper feeding shaft 245 stops. In this way, the pickup roller 230 is able to transport the paper P using the drive from the paper transport drive unit 66 to the paper feeding shaft 245, but after the shutdown of drive from the paper transport drive unit 66 to the paper feeding shaft 245, it is able to rotate idly at the paper P transported by the post paper feeding transport rollers 84 on the other side from the papers P stacked on the rotating board 201*c*.

It should be noted that the drive transmission member 247*b* may be any component as long as it transmits the driving force from the one way pulley 247*a* to the pickup roller 230, and in the present embodiment is provided with a coupling member (herein, a pulley hereinafter referred to as pickup pulley) 247*c* arranged in the pickup shaft 231 of the pickup roller 230 so as to disable relative rotation, and an endless pickup drive belt 247*d* that is wound onto the pickup pulley 247*c* and the one way pulley 247*a*.

The rotating roller 243 is a cylindrical member such as a bearing member for example, an inner circumferential surface of which fits to an outer circumferential surface of the paper feeding roller 241. And the outer circumferential surface of the rotating roller 243 readily moves relatively in the circumferential direction of its axis with respect to the outer circumferential surface of the paper feeding roller 241. In other words, the rotating roller 243 and the paper feeding roller 241 readily rotate relatively together on their axes.

The paper feeding device 110 provided in this configuration applies a transport force to curled papers P through the roller belt 244 that spans between the pickup roller 230 and the paper feeding roller 241, and is thereby capable of properly transporting curled papers P. Moreover, the roller belt 244 is capable of moving relatively in the circumferential direction with respect to the outer circumferential surface of the paper feeding roller 241 and obtains rotational drive from the pickup roller 230, and therefore after the paper P has passed the pickup roller 230 it is capable of stopping in a state in which the rotation of the pickup roller 230 is independent from the rotation of the paper feeding roller 241, and is capable of allowing rotation of the paper feeding roller 241 after rotation of the pickup roller 230 has stopped. That is, the pickup roller 230 can stop rotation independent from the paper feeding roller 241 even when the paper feeding roller 241 is rotating after the trailing edge of the uppermost positioned paper P of the papers P loaded on the rotating board 201*c* has passed, and consequently does not pull out the next paper P. The roller belt 244 may also readily move relatively in the circumferential direction with respect to the outer circumferential surface of the paper feeding roller 241.

With this paper feeding device 110, in using the paper feeding roller 241 to transport the paper P pulled out by the pickup roller 230, a transport force can be applied to the curled paper P without pulling out the next paper P, and in this way paper feeding problems such as paper feeding delays and jamming caused by curling can be reliably prevented.

Further still, in the present embodiment, the rotating roller 243 is arranged so as to readily rotate on the same axis as the paper feeding roller 241, and therefore the configuration is simple. And since the roller belt 244 spans between the pickup roller 230 and the rotating roller 243, while it is capable of stopping in a state in which the rotation of the pickup roller 230 is independent from the rotation of the paper feeding roller 241 after the trailing edge of the paper P has passed the pickup roller 230, it is capable of causing the paper feeding roller 241 to rotate smoothly after rotation of the pickup roller 230 has stopped.

In the present embodiment, the roller belt 244 is installed such that a pickup roller side belt outer diameter r1, which is the outer diameter of a portion thereof wound onto the pickup roller 230 side (see R1 in FIG. 6A) is not greater than an outer diameter r2 of the pickup roller 230. Here, a central area of the pickup roller 230 in the axial direction of its outer circumferential surface is indented extending along its entire circumferential direction, and the roller belt 244 is wound onto an indented portion 230*a* thereof. A depth of the indented portion 230*a* is not greater than a thickness of the roller belt 244. Furthermore, roller belt 244 is installed such that a paper feeding roller side belt outer diameter r3, which is the outer diameter of a portion thereof (see R2 in FIG. 6A) wound onto the paper feeding roller 241 side (herein, the rotating roller 243), is smaller than an outer diameter r4 of the paper feeding roller 241.

Here, a central area of the paper feeding roller 241 in the axial direction of its outer circumferential surface is indented extending along its entire circumferential direction, and the rotating roller 243 is provided at an indented portion 241*a* thereof, and further still, the roller belt 244 is wound over that. A depth of the indented portion 241*a* is deeper than a total of a thickness of the rotating roller 243 and a thickness of the roller belt 244.

Operation of Paper Feeding Device

Next, description is given regarding operation of the paper feeding device 110 according to the present embodiment. In the paper feeding device 110 according to the present embodiment, when a job request is preformed at the image forming apparatus 130, the rotating board 201*c* is caused to rotate by the elevation drive portion 260 from the state shown in FIG. 4A so as to approach the pickup roller 230, and when the papers P on the rotating board 201*c* are thereby raised, the papers P contact the pickup roller 230, and when the papers P are further raised, the first detection member 271 detects the second detection member 272 as shown in FIG. 4B, and the raising of the papers P stops. Then, the pickup roller 230 feeds out the paper P from the rotating board 201*c* to the nip portion γ between the paper feeding roller 241 and the separation roller 242, and the sheets P are fed sheet by sheet.

Next, when a leading edge position of the paper P is detected by the transport sensor 171 as shown in FIG. 6A, drive from the paper transport drive unit 66 to the paper feeding shaft 245 is shut down after a predetermined time has passed according to an internal timer, and transport of the paper P is carried out by the post paper feeding transport rollers 84 only.

Figure 8A:
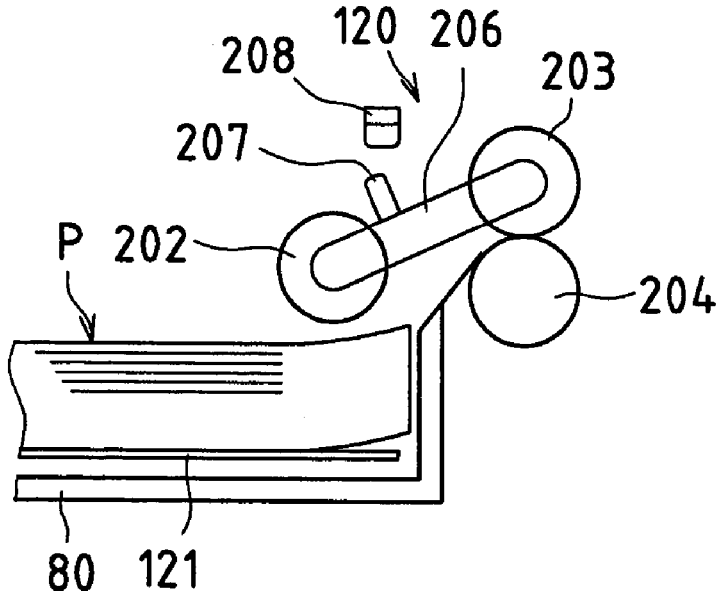
FIG. 8A and FIG. 8B are schematic views for describing a conventional paper feeding device provided with a pickup roller and a paper feeding roller.
Figure 8B:
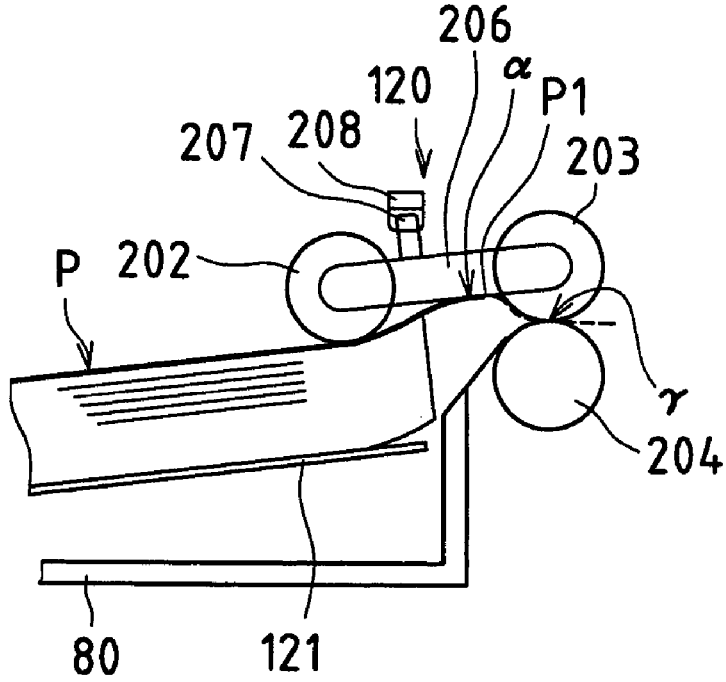

In a conventional paper feeding device, the papers P curl easily under environment conditions of a low temperature and low humidity (10° C., 20% RH) or a high temperature and high humidity (30° C., 85% RH) for example. In particular, in a case where the Papers P is a paper having a certain thickness such as firm cardboards and glossy papers or the like whose the basis weight (grammage) is 100 g/m$^2$ or greater, poor transport force may occur due to frictional load at the contact portion α between the paper P and the transport guide member 206 when curled papers P are fed while in contact with the transport guide member 206 as shown in FIG. 8B. It should be noted that the force applied to the papers P during pickup is originally set to a low transport force in consideration of preventing multi feeding of the papers P. Here, a low transport force is 1.961 N to 3.432 N (200 gf to 350 gf) for example. Thus, there is a tendency for poor transport force to occur due to friction and the effects of paper feeding problems caused by curling to become more prevalent.

That is, a conventional problem is that in transporting curled papers P, in particular where edge portions P1 and P3 have come gradually higher than the central area P2 in the paper transport direction X (hereinafter referred to as upward curling), the paper P advances toward the paper feeding roller 241 due to rotation of the pickup roller 230, but the leading edge portion P1 of the curled paper P becomes obstructed by the transport guide member 206 between the pickup roller 230 and the paper feeding roller 241, thereby causing paper feeding delays. Furthermore, in the case where there is a large amount of curling in the papers P, the load of the obstruction become proportionally larger, which unfortunately causes jamming.

In regard to this point, with the paper feeding device 110 according to the present embodiment, since the rotating roller 243, which is provided readily rotating on the paper feeding roller 241, and the pickup roller 230 are linked by the roller belt 244, a transport force can be applied to the paper P between the pickup roller 230 and the rotating roller 243.

Furthermore, the pickup roller side belt outer diameter r1 of the roller belt 244 is set substantially equivalent to the outer diameter r2 of the pickup roller 230, and paper feeding roller 241 side belt outer diameter r3 of the roller belt 244 is set substantially equivalent to the outer diameter r4 of the paper feeding roller 241. Furthermore, the transport guide member 206 is provided on an inner side of the roller belt 244. Thus, the leading edge portion P1 of the upward curling paper P is able to contact the roller belt 244 without touching the transport guide member 206. And even when the leading edge portion P1 of the upward curling paper P contacts the roller belt 244, it receives a transport force from the roller belt 244 and is transported. In this way, stable paper transport can be achieved.

Here, the pickup roller side belt outer diameter r1 is not greater than the outer diameter (final outer diameter) r2 excluding the indented portion 230*a* of the pickup roller 230, and, the paper feeding roller side belt outer diameter r3 is smaller than the outer diameter (final outer diameter) r4 excluding the indented portion 241*a* of the paper feeding roller 241. In other words, a relationship of at least one of expression (1) and expression (2) below is established.

$$r1 \leqq r2 \qquad \text{expression (1)}$$

$$r3 < r4 \qquad \text{expression (2)}$$

Next, description is given of operation during paper feeding. As shown in FIG. 6A to FIG. 6C, when the paper feeding shaft 245 is rotationally driven due to commencement of paper feeding operations, drive is transmitted to the one way pulley 247*a* and the one way coupling 246. Then, drive of the roller belt 244 is obtained by the pickup roller 230 via the one way drive transmission mechanism 247 from the paper feeding shaft 245. That is, when the paper feeding shaft 245 rotates and drive is transmitted to the one way pulley 247*a*, drive is transmitted to the pickup pulley 247*c* via the pickup drive belt 247*d*, then further still drive is transmitted to the roller belt 244 via the pickup roller 230. When the upward curling paper P contacts the roller belt 244 at this time, a transport force is applied from the roller belt 244 to the paper P.

On the other hand, when the paper feeding shaft 245 is rotationally driven and drive is transmitted to the one way coupling 246 at the same time as the one way pulley 247*a*, the drive is transmitted to the paper feeding roller 241 such that the paper feeding roller 241 rotates. When the upward curling paper P passes the paper feeding roller 241 as described above and is transported to the post paper feeding transport rollers 84 and the transport sensor 171, drive from the paper transport drive unit 66 to the paper feeding shaft 245 is shut down after a predetermined time has passed according to an internal timer, and the rotational driving of the paper feeding shaft 245 stops. When this happens, the paper feeding roller 241, which is sandwiching the paper P between itself and the separation roller 242, rotates idly due to the pulling out of the paper P being transported by the post paper feeding transport rollers 84.

Since there is no rotating roller 243 in a conventional configuration and the roller belt 244 obtains drive from the paper feeding roller 241, rotation of the pickup roller 230 also occurs accompanying rotation of the paper feeding roller 241.

However, in the present embodiment, although the paper feeding roller 241 rotates idly due to the paper P when the trailing edge of the paper P passes the pickup roller 230, since the rotating roller 243 is provided to readily rotate on the same axis as the paper feeding roller 241, the roller belt 244 does not rotate even when the paper feeding roller 241 rotates and only the paper feeding roller 241 rotates idly. That is, the pickup roller 230 does not rotate even though the paper feeding roller 241 rotates, and therefore it is possible to prevent the next paper P loaded on the rotating board 201*c* from also being fed.

In the present embodiment, when the relationship of the first expression (1) is established, namely that the pickup roller side belt outer diameter r1 is not greater than the pickup roller 230 final outer diameter r2, the uppermost positioned paper P loaded on the rotating board 201*c* can be pulled out by the pickup roller 230 very favorably. And in the case where the relationship of the expression (2) is established, namely that the paper feeding roller side belt outer diameter r3 is smaller than the paper feeding roller 241 final outer diameter r4, the paper P can be pulled out smoothly from between the paper feeding roller 241 and the separation roller 242 even when the rotation of the pickup roller 230 stops so as to stop the movement of the roller belt 244.

It should be noted that the paper feeding device according to an embodiment of the present invention was here illustrated using as an example a case in which it was applied in a paper feeding tray 83, but it may also be applied to the large capacity cassette 81 or the manual feeding tray 82 provided in the image forming apparatus 130 according to the present embodiment.

The present invention can be embodied and practiced in other different forms without departing from the spirit and essential characteristics thereof. Therefore, the above-described embodiments are considered in all respects as illustrative and not restrictive. The scope of the invention is indicated by the appended claims rather than by the foregoing description. All variations and modifications falling within the equivalency range of the appended claims are intended to be embraced therein.

What is claimed is:

1. A paper feeding device, comprising:

a pickup roller for pulling out an uppermost positioned sheet of loaded sheets, and a paper feeding roller for transporting the sheet pulled out by the pickup roller, wherein spanning between the pickup roller and the paper feeding roller, a roller belt is provided that is capable of moving relatively in a circumferential direction with respect to an outer circumferential surface of the paper feeding roller, and the roller belt obtains rotational drive from the pickup roller.

2. The paper feeding device according to claim 1, comprising a freely rotating roller arranged on a same axis as the paper feeding roller, wherein the roller belt spans between the pickup roller and the rotating roller.

3. The paper feeding device according to claim 1, wherein the roller belt is installed such that an outer diameter of a portion winding around the paper feeding roller side is smaller than a diameter of the paper feeding roller.

4. The paper feeding device according to claim 1, wherein the roller belt is installed such that an outer diameter of a portion winding around the pickup roller side is not greater than a diameter of the pickup roller.

5. The paper feeding device according to claim 1, wherein thick papers such as cardboards and glossy papers are used as the sheets.

6. An image forming apparatus comprising a paper feeding device according to claim 1.

* * * * *